US011125036B2

(12) United States Patent
Telfer et al.

(10) Patent No.: US 11,125,036 B2
(45) Date of Patent: Sep. 21, 2021

(54) DOWNHOLE ANCHOR MECHANISM

(71) Applicant: Ardyne Holdings Limited, Aberdeen (GB)

(72) Inventors: George Telfer, Aberdeen (GB); Michael Wardley, Aberdeen (GB); Alan Fairweather, Aberdeenshire (GB)

(73) Assignee: ARDYNE HOLDINGS LIMITED, Aberdeen (GB)

( * ) Notice: Subject to any disclaimer, the term of this patent is extended or adjusted under 35 U.S.C. 154(b) by 44 days.

(21) Appl. No.: 16/491,004

(22) PCT Filed: Mar. 7, 2018

(86) PCT No.: PCT/GB2018/050575
§ 371 (c)(1),
(2) Date: Sep. 4, 2019

(87) PCT Pub. No.: WO2018/162897
PCT Pub. Date: Sep. 13, 2018

(65) Prior Publication Data

US 2020/0018131 A1 Jan. 16, 2020

(30) Foreign Application Priority Data

Mar. 8, 2017 (GB) ..... 1703677

(51) Int. Cl.
*E21B 23/01* (2006.01)
*E21B 33/129* (2006.01)

(52) U.S. Cl.
CPC ..... *E21B 23/01* (2013.01); *E21B 33/129* (2013.01)

(58) Field of Classification Search
CPC .... E21B 23/01; E21B 33/129; E21B 33/1291; E21B 33/1292; E21B 33/1293; E21B 33/1295
(Continued)

(56) References Cited

U.S. PATENT DOCUMENTS 7,487,832 B2 2/2009 Read, Jr.
8,567,510 B2 * 10/2013 Christie ..... E21B 33/1295 166/375
(Continued)

FOREIGN PATENT DOCUMENTS

WO 2009106875 A3 11/2009
WO 2017031419 A1 2/2017

OTHER PUBLICATIONS

International Search Report on Patentability dated Sep. 10, 2019 for PCT/GB2018/050575.
(Continued)

*Primary Examiner* — Frederick L Lagman
(74) *Attorney, Agent, or Firm* — Law Office of Jesse D. Lambert, LLC

(57) ABSTRACT

A downhole anchor mechanism (110) which can be set on at least two successive standard diameters of casing (232). The tool body has a recess into which a split cone (70) is located. The increased thickness of the split cone (70) provides for a greater thickness of slip (90), giving increased radial travel of the slips 90 when moved axially over the split cone (70). The cone (70) and slips (90) are profiled to provide two ramps/slopes for increased structural integrity and a greater ramp angle to reduce the axial travel of the slips to achieve the increased radial travel. The downhole anchor mechanism (110) provides anchoring of a work string on two standard diameters of casing in a single trip in a wellbore.

17 Claims, 5 Drawing Sheets

(58) Field of Classification Search
USPC ..... 166/382, 134, 137, 138
See application file for complete search history.

(56) References Cited

U.S. PATENT DOCUMENTS

| | | | | |
|---|---|---|---|---|
| 8,881,818 | B2 * | 11/2014 | Crow | E21B 29/005 166/298 |
| 8,881,819 | B2 * | 11/2014 | Crow | E21B 23/01 166/298 |
| 2001/0050172 | A1 * | 12/2001 | Tolman | E21B 17/203 166/297 |
| 2006/0272828 | A1 * | 12/2006 | Manson | E21B 23/006 166/387 |
| 2015/0292284 | A1 * | 10/2015 | Lemm | E21B 33/1291 166/216 |
| 2016/0084025 | A1 * | 3/2016 | Jeske | E21B 33/1292 166/387 |
| 2019/0257193 | A1 * | 8/2019 | Telfer | E21B 23/04 |

OTHER PUBLICATIONS

UK Search and Examination Report dated Jul. 3, 2017 for GB1703677.3.

International Search Report dated Jun. 7, 2018 for PCT/GB2018/050575.

* cited by examiner

Section A-A

DOWNHOLE ANCHOR MECHANISM

The present invention relates to downhole anchors and in particular to a downhole anchor mechanism which can be set on two successive diameters of casing.

In the curse of constructing an oil or gas well, a hole is drilled to a pre-determined depth. The drilling string is then removed and a metal tubular or casing is run into the well and is secured in position using cement. This process of drilling, running casing and cementing is repeated with successively smaller drilled holes and casing sizes until the well reaches its target depth. At this point, a final tubular or tubing is run into the well.

As each casing section is installed inside a previously installed section consequently its external diameter has to be less than the internal diameter of the installed section. Furthermore it is necessary that an annular gap between the internal diameter of the installed section and the external diameter of the next section is sufficient to accommodate the connecting means between the two sections which includes hanging and packing means as well as the additional diameter of the joints between each length of tubing making up each section. In well construction, casing, liner, pipe and other tubing, herein collectively referred to as casing, in a well is therefore supplied in standard diameters e.g. 5", 5½", 6", 6⅝" 7", 7⅝", 8⅝", 9⅝", 10¾", 11¾", 13⅜", 14", 16", 18⅝" and 20".

Due to the range of casing diameters, it will be appreciated that other casing, strings and tools run into a well need to be sized so as to fit within the diameter of installed casing in which they wish to be used. For downhole tools which need to expand and contact the casing wall, such as packers and anchors, it is an objective of their design to have the slimmest profile for insertion through the casing and then extend as much as possible for sealing and gripping. Consequently, these downhole tools are typically designed and specified for a single casing diameter. In this way, the retracted tool can have a diameter which is as close to the casing diameter as possible so as to provide the minimum distance over which the tool must extend to contact the casing, in use.

Designing and building a separate downhole tool for each casing diameter is expensive. Additionally, where a downhole tool could undertake a task multiple times on a single trip into a well, the downhole tool and string must be pulled out of the hole to replace the downhole tool or at least change components thereof, if the tasks are being performed on different diameters of casing in the well. Making multiple trips in and out of the well is both time consuming and expensive.

A prior art anchor mechanism is illustrated in FIGS. 1A and 1B. The present invention is an improvement on this design. For completeness in understanding this invention, the prior art anchor mechanism of FIGS. 1A and 1B will be reviewed to provide a framework to understand the present invention.

FIG. 1A is a sectional view of an anchor mechanism 10 in a run-in configuration. The principle of operation of the anchor mechanism 10 is to force slips 12 up a slope or ramp 14 of a cone 16 so that the slips 12 move outwards and engage the casing 30. The slips 12 are moved axially by a piston in the form of a sleeve 18 actuated by a hydraulic force being the fluid pressure against a face 20 of the sleeve 18. The sleeve 18 acts against a spring 22. The slips 12 are retained by an underside 24 of the sleeve 18. On pumping fluid through the central bore 26, fluid enters ports 28 to act against face 20. Sleeve 18 moves axially acting on the slips 12 and forcing them up the ramp 14 of the cone 16. The slips 12 move radially outwards until their travel is limited by the underside 24 of the sleeve 18. As the slips 12 travel outwards they will engage the inner surface 32 of the casing 30. This is as illustrated in FIG. 1B.

In this example, the slips 12 engage 9⅝" casing 30. To set the slips into the surface 32 of the casing 30 an over pull would typically be applied which forces the cone 16 under the slips 12 to drive them further outwards to anchor onto the casing 30. Such action means that the fluid through the bore 26 can be stopped or varied without activating or deactivating the slips 12. When the anchor mechanism requires to be unset, weight is set down on the mechanism 10, so as to move the cone 16 away from the slips 12, the release of support coupled with the bias on the spring 22 releases the slips 12 from contact on the inner surface 32 of the casing 30. The slips 12 are drawn back and the anchor mechanism can be moved and reset elsewhere.

As described above this prior art anchor mechanism is limited to use in a single casing diameter. This is due to the fact that the diameter of the tool body is larger than the next casing size down, 8⅝", and the slips 12 are close to or at their maximum extension in the 9⅝" casing. Further the cone 16 is a unitary piece which is slid over the lower end of the tool body and, as the slips must remain within the tool body in the retracted position and be supported by the tool body in the expanded position so as to provide a strong enough grip to resist the anticipated load, this combination severely limits the distance of radial travel which the slips can make. As is illustrated in FIGS. 1A and 1B it is seen that the radial distance across the annulus between outer surface of the slips and the inner surface of the casing is significantly smaller, and typically no greater than half the thickness of the slips.

It is therefore an object of the present invention to provide an anchor mechanism which obviates or mitigates at least some of the disadvantages of the prior art.

It is a further object of the present invention to provide an anchor mechanism which can be used to anchor on at least two successive standard diameters of wellbore casing.

According to a first aspect of the present invention there is provided an anchor mechanism for gripping wellbore casing, comprising:

a tubular body having a central bore between an inlet and a first outlet, the inlet and first outlet being adapted for connection in a work string to be run into the casing;

a recess provided in and around an outer surface of the tool body;

a split cone arranged in the recess, the split cone having an outer surface including a first profile, the first profile having at least one ramp;

a plurality of selectively operable slips, each slip having an outer surface configured to grip an inner surface of the casing and an inner surface including a second profile, the second profiling mating with the first profile in a first configuration; and piston means operable to move the slips over the split cone between the first configuration wherein the slips are located within the recess, a second configuration wherein the outer surface of the slips contacts the inner surface of casing of a first standard diameter and a third configuration wherein the outer surface of the slips contacts the inner surface of casing of a second standard diameter;

wherein the first standard diameter and the second standard diameter are at least two successive standard diameters of wellbore casing.

By having a split cone which can be assembled around the tool body, a recess can be created in the tool body. The depth of the recess allows for an increased thickness of the slips and so provides a greater radial distance of travel available for the slips. This anchor mechanism can therefore expand the slips to grip on at least two successive standard diameters of wellbore casing. The standard diameters for casing may selected from a group comprising 5", 5½", 6", 6⅝" 7", 7⅝", 8⅝", 9⅝", 10¾", 11¾", 13⅜", 14", 16", 18⅝" and 20".

Preferably the split cone is of multi-part construction. More preferably the split cone is of two-part construction. By having the cone split longitudinally in two halves, the structural integrity of the cone is not adversely affected particularly as the cone can now have a greater wall thickness.

Preferably, the first profile includes two spaced apart ramps. By providing two ramps, giving two slopes when the cone is considered in longitudinal cross-section, the angle of each slope can be kept high so that there is only a short axial travel for the slips to reach the casing while providing sufficient length of gripping surface on the slips to the casing and support from the cone on the slips.

Preferably a first ramp is shorter than a second ramp wherein the second ramp is arranged towards a base of the split cone. This arrangement allows the slips to remain entirely inside the recess while still providing mating contact between the first and second profiles when the slips are extended.

Preferably, the first ramp ends at a first plateau, the first plateau having a surface parallel to a longitudinal axis through the tool body. Such a plateau provides for an adequate wall thickness to the slip at the top of the first ramp in the first configuration to prevent creation of a weak point on the slip which could break under load.

Preferably, the second ramp begins with a second plateau, the second plateau having a surface parallel to a longitudinal axis through the tool body. Such a plateau provides for an adequate wall thickness to the split cone at the bottom of the second ramp to maintain the structural integrity of the split cone.

Preferably, the tool body is rotatable relative to the slips. In this way the anchor can be used to stabilise the work string while tools below can be operated by rotation of the work string. Preferably, a bearing is located between a base of the split cone and a side wall of the recess. In this way with the slips set, and the split cone being held on a ledge between the ramps on the slips, the bearing is not compressed and thus free rotation will occur.

Preferably, the piston means comprises a sleeve axially moveable relative to the tool body and arranged to act on a face of each slip. The piston means may be mechanically or hydraulically operated. In an embodiment, the piston means is hydraulically operated by action of fluid from the central bore. This allows the slips to be moved remotely by pumping fluid from surface above a pre-set flow rate threshold. The sleeve of the anchor mechanism may be configured to move in response to fluid pressure acting on the sleeve or at least part of the sleeve.

Preferably, the anchor mechanism includes biasing means to hold the slips in the first configuration. In an embodiment, the biasing means is a spring arranged to act against the sleeve. Advantageously, the flow rate threshold may be set by changing the spring force acting on the sleeve. This allows other tools on the string to be activated by fluid pressure in the central bore also.

Preferably a first end of each slip is located under the sleeve. In this way the sleeve can be used to retain a portion of the slips within the tool body and limit their radial travel from the tool body.

According to a second aspect of the present invention there is provided a method of using a downhole anchor in a wellbore, comprising the steps:

(a) mounting an anchor mechanism according to the first aspect on a work string;
(b) running the work string in the wellbore and locating the anchor mechanism in casing of a first standard diameter;
(c) setting the slips to anchor the anchor mechanism to an inner surface of the casing of a first standard diameter;
(d) performing a task in the wellbore;
(e) unsetting the slips to release the anchor mechanism the inner surface of the casing of a first standard diameter;
(f) moving the work string in the wellbore and locating the anchor mechanism in casing of a second standard diameter; and
(g) setting the slips to anchor the anchor mechanism to an inner surface of the casing of a second standard diameter;

wherein the first standard diameter and the second standard diameter are at least two successive standard diameters of wellbore casing.

In this way, the work string does not have to be pulled out of the well bore and a different anchor mechanism mounted on the work string to anchor to the different diameter casing. This allows multiple tasks to be performed in the wellbore on a single trip in different diameters of casing.

The first standard diameter and the second standard diameter may selected from a group comprising 5", 5½", 6", 6⅝" 7", 7⅝", 8⅝", 9⅝", 10¾", 11¾", 13⅜", 14", 16", 18⅝" and 20". In an embodiment the first and second standard diameters are 9⅝" and 10¾".

Preferably the method includes the step of hydraulically actuating the anchor mechanism to contact the slips to the inner surface of the casing.

This allows the slips to be moved remotely by pumping fluid from surface above a pre-set flow rate threshold.

Preferably the method includes the step of applying an over pull to the anchor mechanism once the slips have contacted the inner surface of the casing. This sets the anchor mechanism to prevent accidental release of the anchor mechanism. The tension or pulling force may wedge or lock the slips between the outer surface of the cone and the casing or downhole tubular. By setting the anchor mechanism the fluid pressure may be reduced below the pre-set threshold flow rate or stopped without the anchor mechanism being deactivated.

Preferably, the anchor mechanism is unset by applying a downward force to the tool. This force will pull the split cone away from the slips and then the spring will bias the slips back into the recess.

In the description that follows, the drawings are not necessarily to scale. Certain features of the invention may be shown exaggerated in scale or in somewhat schematic form, and some details of conventional elements may not be shown in the interest of clarity and conciseness. It is to be fully recognized that the different teachings of the embodiments discussed below may be employed separately or in any suitable combination to produce the desired results.

Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

All numerical values in this disclosure are understood as being modified by "about". All singular forms of elements, or any other components described herein including (without limitations) components of the apparatus are understood to include plural forms thereof.

Embodiments of the present invention will now be described, by way of example only, with reference to the accompanying drawings of which:

Figure 1A:
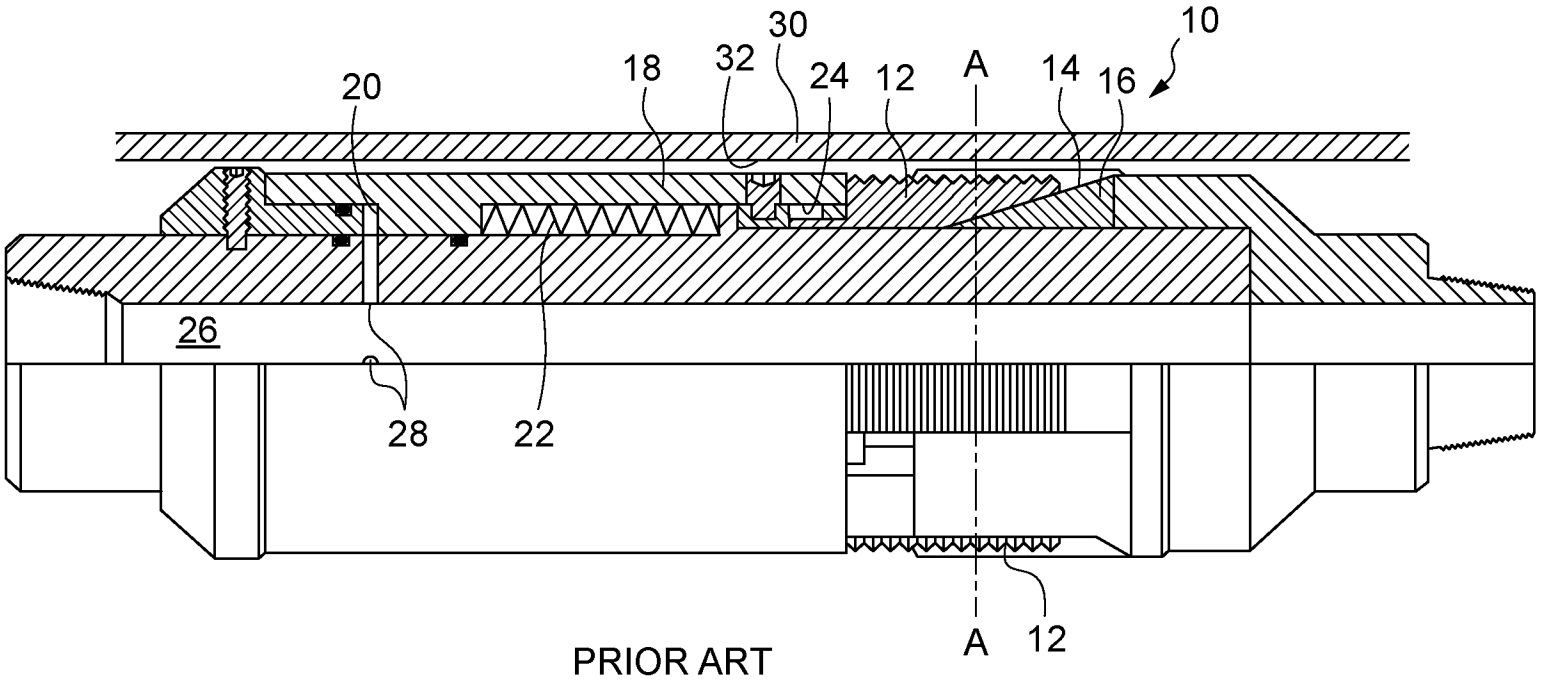
PRIOR ART Figure 1A
FIGS. 1A and 1B are longitudinal section views of a prior art anchor mechanism in run-in and set positions.
Figure 1B:
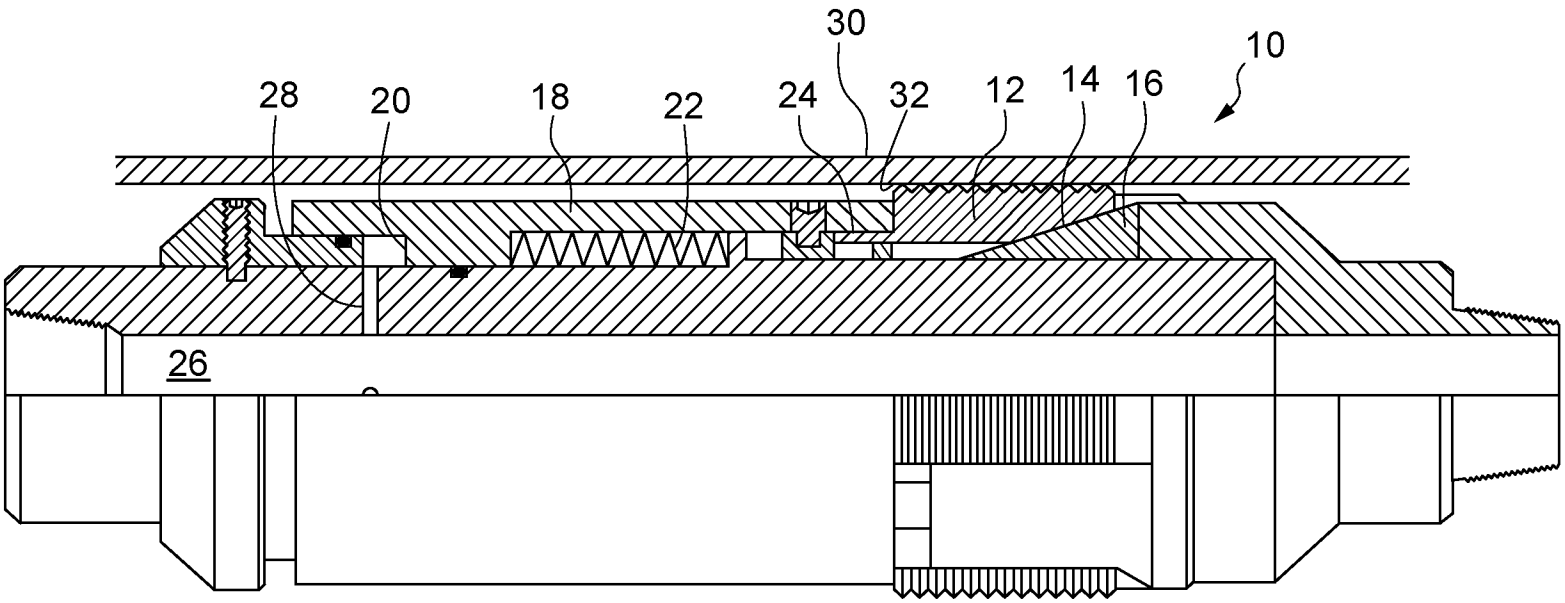
PRIOR ART Figure 1B
Figure 2:
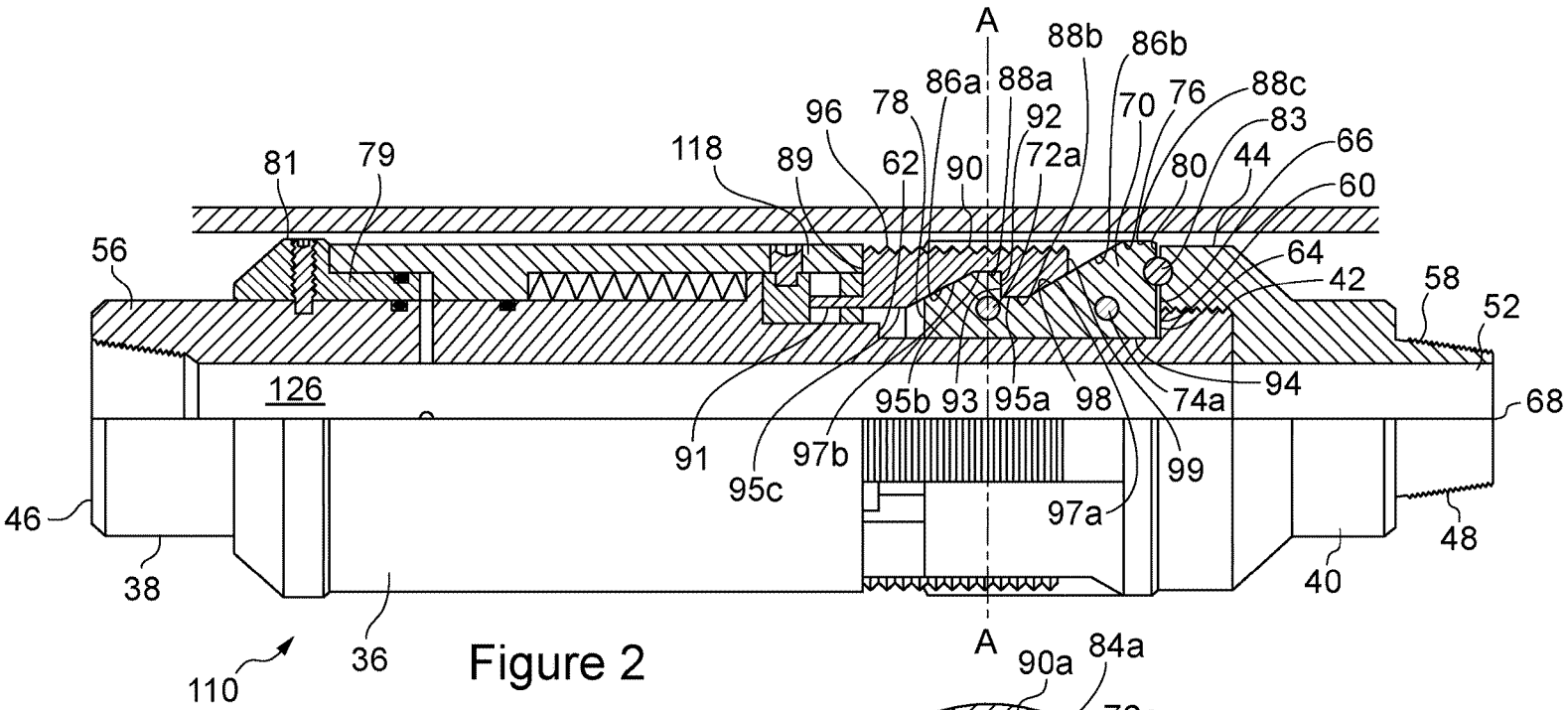
FIG. 2 is a longitudinal section view of an anchor mechanism in a first configuration according to an embodiment of the present invention.

Reference is initially made to FIG. 2 of the drawings which illustrates an anchor mechanism, generally indicated by reference numeral 110, according to an embodiment of the present invention. Like parts to those of FIG. 1 have been given the same reference numeral with the addition of 100.

Anchor mechanism 110 is formed on a two part cylindrical body 36, having an upper body portion 38 and a lower body portion 40 which are threadably connected. The threaded coupling 42 simplifies assembly. The body 36 has a central bore 126 providing a through passage with a fluid inlet 50 at an upper end 46 and a first fluid outlet 52 at a lower end 48. At the upper end 46 there is a box section 56 and at the lower end 48 there is a pin section 58, for connecting the anchor mechanism 110 into a work string (not shown) as is known in the art.

A difference as compared to FIG. 1A of the prior art mechanism 10 is in the presence of a recess 60 located on an outer surface 144 of the tool body 36. In this embodiment, the recess 60 extends into the upper tool body 38 hence presenting top 62 and bottom 64 side walls of the recess 60. Side walls 62,64 will have annular faces which are continuous and uninterrupted. Lower side wall 64 is increased in depth by the end face 66 of the lower tubular body 40. The presence of the recess 60 prevents a single piece cone 16 being slid over the upper tubular body 38.

Figure 3:
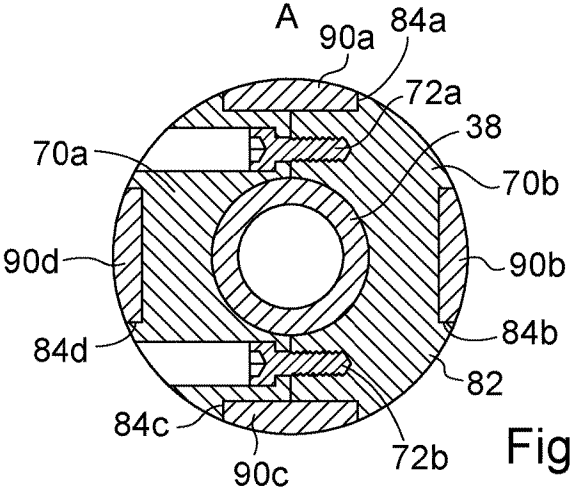
FIG. 3 is a view along lines A-A of FIG. 2.

Cone 70 is therefore made of sections which are fixed together to make up the complete cone 70. In the embodiment shown, cone 70 is of two-part construction, being split longitudinally in two sections 70*a* and 70*b*. This is as illustrated in FIG. 3, being a section through the cone 70, perpendicularly to a central or longitudinal axis 68 of the anchor mechanism 110. Split cone 70 is joined by two pairs of screws 72*a,b* and 74*a,b*. The cone 70 may be frustoconical having a flat end 78 parallel to its base 80, both of which are perpendicular to the central axis 68. A central bore of the cone 70 has an inner surface 94 with a diameter which matches the outer diameter of the recess 60 so that the cone 70 fits within the recess 60 and the base 80 resting against side wall 64 and end face 66. The depth of the cone 70 at its base is sized to be just greater than the depth of the side wall 64 and the width of the end face 66. In this way the cone 70 protrudes by a small amount from the tool body 36. In the preferred embodiment the cone is more of a two part cylinder, see FIG. 3, providing an outer surface 76, which when seen in this cross-section has a circular rim 82 having channels 84*a-d* equidistantly spaced around the rim 82. Each channel 84*a-d* provides a box groove arranged in parallel to the central axis 68, into which is arranged a slip 90*a-d*. The channels 84*a-d* support the slips 90*a-d* rotationally during movement longitudinally along the channels 84*a-d*.

The outer surface 76 at each channel 84*a-d* defines, starting at the flat end 78, a first slope or ramp 86*a*, a first plateau 88*a*, a dropped ledge 92, a second plateau 88*b*, a second ramp 86*b* and a third plateau 88*c* ending at the base 80. The first ramp 86*a* is shorter than the second 86*b* giving a Christmas tree effect to the profile, with the ramp angle being identical on both. This angle is 30 degrees to the central axis 68. This is steeper than the prior art, so that additional radial travel is available over a shorter axial distance for the slips 90. The first and second plateaus 88*a*,88*b* have the same axial length and remove the acute angles and points found on prior art cones. These plateaus 88 give the maximum thickness to the cone 70 along its length without compromising the thickness of the slips 90, so that the structural integrity of both the cone 70 and the slips 90 can be high. The addition a ledge 92 at the plateaus 88*a*,88*b* allows for an overhang and increased active surface areas when tension is applied.

There are four slips 90*a-d* spaced equidistantly around the cone 70 and located in the channels 84*a-d* respectively. Each slip 90 is an elongate member having an outer surface 96 with a curvature to match that of the rim 82. The outer surface 96 is knurled, grooved or toothed to provide a suitable grip and bite into the inner surface of the casing on contact. The inner surface 98 of the each slip 90 is the reverse of the outer surface 76 of the cone 70 along the channel 84. This is done to provide a mating arrangement. The slip 90 has a flat end 99 arranged towards the lower end 48 of the tool body 36 and located on the ramp 86*b* in FIG. 2, a first slope 97*a* matching the second ramp 86*b* at the ramp angle, a first level 95*a* matching the second plateau 88*b*, a ledge 93 matching dropped ledge 92, a second level 95*b* matching the first plateau 88*a*, a second slope 97*b* matching the first ramp 86*a* at the ramp angle, and a third level 95*c*. Of note in the design is that the length of the second slope 97*b* is greater than the first ramp 86*a*, to provide sufficient travel to the slip 90. Additionally level 95*c* is the surface of a retaining piece 91 of the slip 90 to sit below the sleeve 118. Slip 90 also has a rear face 89 as per the prior art slip design, but this is thicker, probably one and half times thicker as the increased depth of the recess 60 allows for this. As compared to the prior art slip 90 has a similar structural integrity as the slip 90 maintains has a greater thickness. The area of the outer surface 96 of each slip is comparable to that of the prior art so that no gripping potential is lost in present invention.

In creating the recess 60, side wall 87 of a stop block 85 is now longer giving the retaining piece 91 of the slip 90 a greater radial distance through which it can travel before it reaches the underside 124 of the sleeve 118. The remaining elements such as the ports 128, sleeve 118 and spring 122 are all as for the prior art mechanism 10.

An additional feature is also provided on the anchor mechanism 110.

Between the base 80 of the cone 70 and the end face 66 of the lower body 40 there is located a bearing 83. Bearing 83 is as known in the art and allows the tubular body 36 to rotate relative to the cone 70. Indeed if the slips 90 are set, the slips 90 and cone 70 can remain stationary and the remaining components can rotate with the string. This allows the transmission of rotation through the anchor mechanism 110 when the anchor mechanism 110 is set.

FIG. 2 illustrates the anchor mechanism 110 of the present invention in a first configuration. This is the run-in position. The slips 90 are entirely located within the body 136 of the anchor mechanism 110, so that the outer surface 44 of the body 36 and the gripping surface 96 of the slips 90 lie below the third plateau 88*c* of the cone 70 and the outer surface 81 of an upper stop 79. This prevents the gripping surface 96 contacting any casing on run-in. The slips 90 remain in the recess 60 in a mated position with the cone 70 by the action of the spring 122 and fluid on the end face 99.

Figure 4:
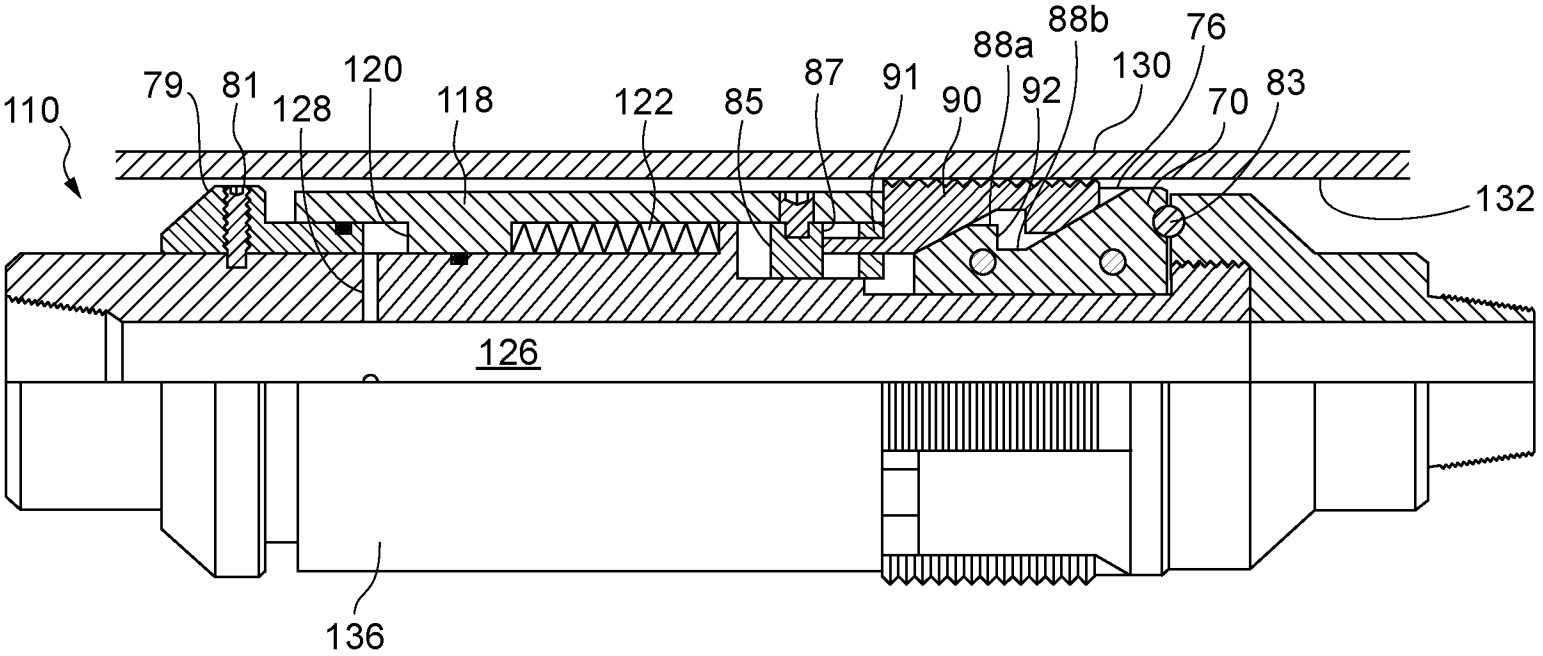
FIG. 4 is a longitudinal section view of the anchor mechanism of FIG. 2 in a second configuration according to an embodiment of the present invention.

When the anchor mechanism 110 is located in casing of a first standard diameter, for example 9⅝", and an anchor is required, the slips 90 can be set. This is achieved in an identical manner to the prior art anchor mechanism 10 by forcing slips 90*a-d* up the ramps 86*a,b* of the two-piece cone 70 so that the slips 90*a-d* move outwards and engage the casing 30. The slips 90*a-d* are moved axially by a piston in the form of the sleeve 118 actuated by a hydraulic force being the fluid pressure against a face 120 of the sleeve 118. The sleeve 118 acts against a spring 122. The force of the spring 122 is selected to determine the pressure of fluid which will actuate the sleeve 118. On pumping fluid through the central bore 126, fluid enters ports 128 to act against face 120. Sleeve 118 moves axially acting on the slips 90*a-d* and forcing them to move axially up the two ramps 86*a,b* of the two-piece cone 70. The slips 90*a-d* move radially outwards until they contact the inner surface 132 of the casing 130. This is as shown in FIG. 4.

Of note is that the slips 90 are only part way up the two ramps 86*a,b*. This is possible due to the thicker slip 90 and the greater radial travel allowed over the side wall 87 of the stop block 85 from the increased depth provided by the recess 60. The radial distance travelled by the slip 90 is the same as for the prior art anchor mechanism 10 which in this casing 130, of the same standard diameter as casing 30, would now be at its maximum reach.

The slips 90 have engaged the 9⅝" casing 130. To set the slips 90 into the surface 132 of the casing 130 an over pull is applied which forces the cone 70 under the slips 90 to drive them further outwards to anchor onto the casing 130. The full travel on the cone ramps 86*a,b* has still not been reached. This can be considered as a second configuration as shown in FIG. 4.

With the mechanism 110 now fully anchored, the fluid through the bore 126 can be stopped or varied without activating or de-activating the slips 90. When the anchor mechanism requires to be unset, weight is set down on the mechanism 110, so as to move the cone 70 away from the slips 90, the release of support coupled with the bias on the spring 122 releases the slips 90 from contact on the inner surface 132 of the casing 130. The slips 90 are drawn back and the anchor mechanism 110 can be moved and reset elsewhere.

When unset, the anchor mechanism 110 returns to the first configuration, see FIGS. 2 and 3. The string can now be moved in the casing and the anchor mechanism repositioned. With the present invention, the anchor mechanism 110 can now be positioned in casing 230 of a second standard diameter, being of a greater diameter than the casing 130 of the first standard diameter, without removing the anchor mechanism 110 from the wellbore. In a preferred embodiment, casing 230 is 10¾".

Figure 5:
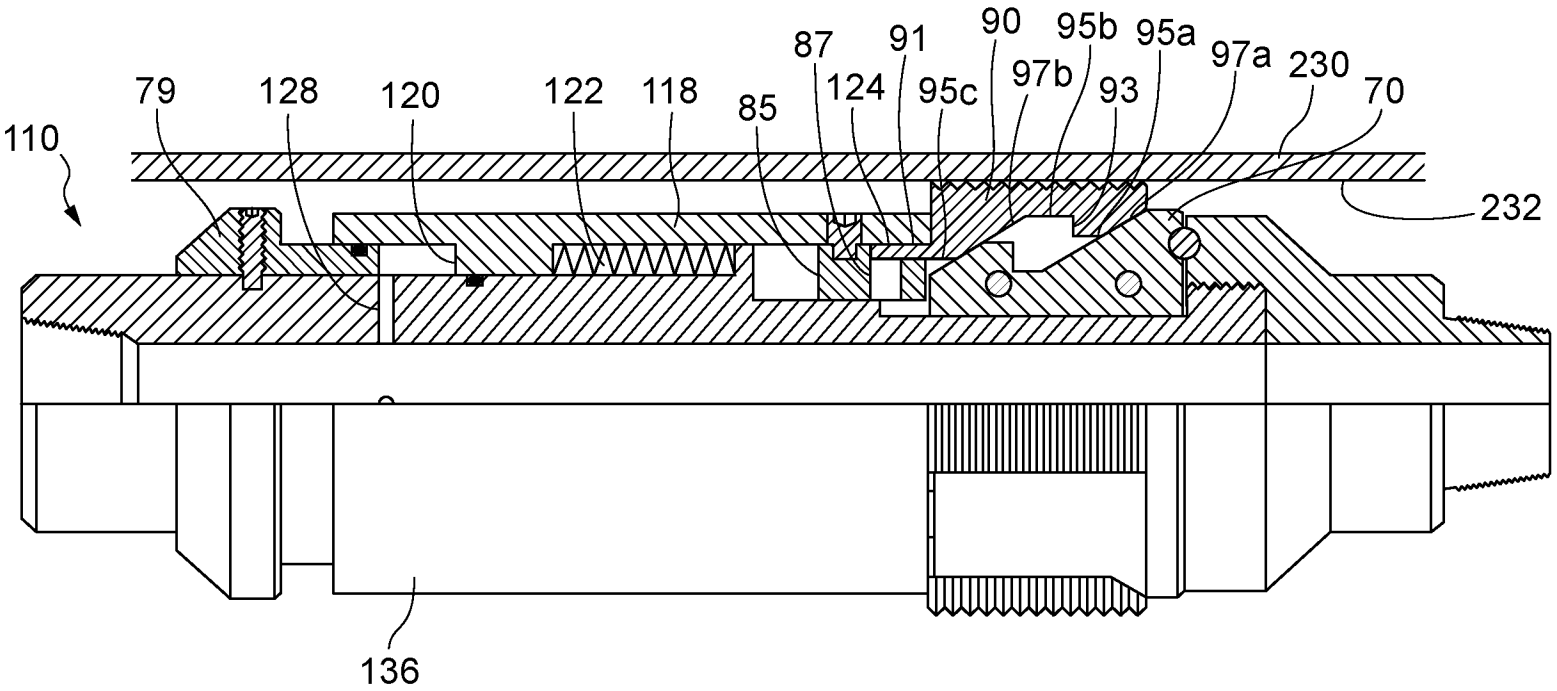
FIG. 5 is a longitudinal section view of the anchor mechanism of FIG. 2 in a third configuration according to an embodiment of the present invention.

From the first configuration, the anchor mechanism 110 can now be set in the wider casing 230 by the same process as for the narrower casing 130. The same slips 90*a-d* are driven axially up the ramps 86*a,b* of the two-piece cone 70 so that the slips 90*a-d* move outwards and engage the casing 230. The slips 90*a-d* are moved axially by a piston in the form of the sleeve 118 actuated by a hydraulic force being the fluid pressure against a face 120 of the sleeve 118. The sleeve 118 acts against a spring 122. On pumping fluid through the central bore 126, fluid enters ports 128 to act against face 120. Sleeve 118 moves axially acting on the slips 90*a-d* and forcing them to move axially up the two ramps 86*a,b* of the two-piece cone 70. The slips 90*a-d* move radially outwards until they contact the inner surface 232 of the casing 230. This is as shown in FIG. 5. Here the sleeve 118 will have moved a greater axial distance than for the second configuration. The retaining piece 91 of the slips 90 has now moved along the entire length of the side wall 87 of the stop block 85. The radial travel of the slips 90 is limited by the underside 124 of the sleeve 118 but this is still sufficient for the slips 90 to travel outwards and engage the inner surface 232 of the casing 230.

In this example, the slips 90 engage 10¾" casing 230. To set the slips 90 into the surface 232 of the casing 230 an over pull is applied which forces the cone 70 under the slips 90 to drive them further outwards to anchor onto the casing 230. This arrangement can be considered as the third configuration and is shown in FIG. 5.

Again such action means that the fluid through the bore 126 can be stopped or varied without activating or de-activating the slips 90. When the anchor mechanism requires to be unset, weight is again set down on the mechanism 110, so as to move the cone 70 away from the slips 90, the release of support coupled with the bias on the spring 122 releases the slips 90 from contact on the inner surface 232 of the casing 230. The slips 90 are drawn back and the anchor mechanism 110 returns to the first configuration so it can be moved and reset elsewhere.

When set in either size casing 130,230, the anchor mechanism 110 allows independent rotation of the string while anchoring the string to the casing 130,230 by virtue of the bearing 83.

In use, the anchor mechanism 110 will be located in a drill string with other tools such as a casing cutter below, for example. The anchor mechanism 110 will be in the first configuration as shown in FIG. 2. The string is run in a cased wellbore until the casing cutter reaches a position in which casing 130 requires to be cut. The anchor mechanism 110 is then set as described hereinbefore with reference to FIG. 4 to be in a second configuration. Once in the second configuration, the casing cutter can be operated by rotation of the drill string and the cutting action can be lubricated by flow of fluid through the bore 126 without losing any grip on the anchor mechanism 110. The anchor mechanism 110 thus advantageously holds the casing 130 in tension while the cut is made. Further tasks may be completed with the string anchored in the wellbore. Following the cut, the anchor mechanism 110 can be unset and returned to the first configuration. Again further tasks may be completed using other tool on the string while still in the wellbore. The string is then raised to locate the anchor mechanism 110 in casing 230 of a different standard diameter than the first casing 130. The anchor mechanism 110 is then set as described hereinbefore with reference to FIG. 5 to be in the third configuration. This anchors the string to a successively greater sized casing were cutting can be repeated if the cutter blades can extend over the greater annular distance between the string and the inside wall of the casing. Alternatively other tools can be operated and other tasks completed.

Anchoring of the string has therefore been achieved in two successive standard diameters of casing on the same trip in a wellbore.

It will be apparent that the anchor mechanism 110 is fully resettable and as such can be used multiple times on a single trip in a wellbore. The anchor mechanism 110 is not limited in use to progressively greater or smaller sized casing diameters and can be set against casings of any diameter in any order. The available casing standard diameters will be determined to be between the size of the outer diameter of cone 70 at plateau 88*c*, as the mechanism 110 must fit within the casing, and this dimension plus twice the depth of the rear face 89 of the slip 90 minus twice the thickness of the sleeve 118. In our preferred embodiment this gives a difference in the standard casing diameters of up to 2". It will also be apparent that if the central bore 126 diameter is reduced, a deeper recess 60 can be formed, which in turn allows for a thicker slip 60 and thus a greater radial travel.

The principle advantage of the present invention is that it provides an anchor mechanism which can be used to anchor on at least two successive standard diameters of wellbore casing.

A further advantage of the present invention is that it provides an anchor mechanism which can be used to anchor on at least two successive standard diameters of wellbore casing using the same slips on a single trip in a wellbore.

It will be apparent to those skilled in the art that modifications may be made to the invention herein described without departing from the scope thereof. For example, while a fluid pressure driven sleeve is used to move the slips, the sleeve may be actuated by alternative means such as mechanical or electrical. Additionally, while the arrangement shows the slips moving axially with respect to a stationary cone, the cone could move axially instead being driven under the slips to force them radially outwards. There may also be further ramps/slopes if a longer gripping area for each slip is required, but the first ramp will always be greater in length than the other ramps. Also, while the terms 'upper' and 'lower' have been used these are relative and the invention finds use in deviated or horizontal wellbores. The present application presents a range of standard casing diameters currently available but it is recognised that there are additional diameters which are available as 'specials' lying within the diameters specified here. The present application can be used on these and it would be expected that such an anchor would then be applicable over three successive diameters of casing. While casing comes in standard diameters it may also come in different weights, which is determined by the thickness of the casing wall. The present invention is intended to operate across at least two standard diameters of casing independent of the casing weight.

We claim:

1. An anchor mechanism for gripping wellbore casing, comprising:

a tool body being tubular with a central bore between an inlet and a first outlet, the inlet and first outlet being adapted for connection in a work string to be run into the casing;

a recess provided in and around an outer surface of the tool body;

a cone arranged in the recess, the cone having an outer surface including a first profile, the first profile having at least one ramp;

a plurality of selectively operable slips, each slip having an outer surface configured to grip an inner surface of the casing and an inner surface including a second profile, the second profiling mating with the first profile in a first configuration; and piston means operable to move the slips over the cone between the first configuration wherein the slips are located within the recess, a second configuration wherein the outer surface of the slips contacts the inner surface of casing of a first standard diameter;

and characterised in that:

the cone is a split cone, of two part construction, as the cone is split longitudinally to create two halves; and the piston means is operable to move the slips over the split cone to a third configuration wherein the outer surface of the slips contacts the inner surface of casing of a second standard diameter;

wherein the first standard diameter and the second standard diameter are at least two successive different standard diameters of wellbore casing, and the standard diameters for casing are selected from a group comprising: 5", 5½", 6", 6⅝" 7", 7⅝", 8⅝", 9⅝", 10¾", 11¾", 13⅜", 14", 16", 18⅝" and 20".

2. An anchor mechanism according to claim 1 wherein the first profile includes two spaced apart ramps.

3. An anchor mechanism according to claim 2 wherein a first ramp is shorter than a second ramp and wherein the second ramp is arranged towards a base of the split cone.

4. An anchor mechanism according to claim 3 wherein the first ramp ends at a first plateau, the first plateau having a surface parallel to a longitudinal axis through the tool body.

5. An anchor mechanism according to claim 4 wherein the second ramp begins with a second plateau, the second plateau having a surface parallel to a longitudinal axis through the tool body.

6. An anchor mechanism according to claim 1 wherein the tool body is rotatable relative to the slips.

7. An anchor mechanism according to claim 6 wherein a bearing is located between a base of the split cone and a side wall of the recess.

8. An anchor mechanism according to claim 1 wherein the piston means comprises a sleeve axially moveable relative to the tool body and arranged to act on a face of each slip.

9. An anchor mechanism according to claim 8 wherein the piston means is mechanically or hydraulically operated.

10. An anchor mechanism according to claim 9 wherein the piston means is hydraulically operated by action of fluid from the central bore.

11. An anchor mechanism according to claim 8 wherein the sleeve is configured to move in response to fluid pressure acting on the sleeve or at least part of the sleeve.

12. An anchor mechanism according to claim 8 wherein a first end of each slip is located under the sleeve.

13. An anchor mechanism according to claim 1 wherein the anchor mechanism includes biasing means to hold the slips in the first configuration.

14. An anchor mechanism according to claim 13 wherein the biasing means is a spring arranged to act against the piston.

15. A method of using a downhole anchor in a wellbore, comprising the steps:

(a) mounting an anchor mechanism on a work string, the anchor mechanism comprising a plurality of operable slips, each slip having an outer surface configured to grip an inner surface of casing;

(b) running the work string in the wellbore and locating the anchor mechanism in casing of a first standard diameter;

(c) setting the slips to anchor the anchor mechanism to an inner surface of the casing of a first standard diameter;

(d) performing a task in the wellbore;

(e) unsetting the slips to release the anchor mechanism from the inner surface of the casing of a first standard diameter; and characterised in that, the method comprises the additional steps of:

(f) moving the work string in the wellbore and locating the anchor mechanism in casing of a second standard diameter; and (g) setting the slips to anchor the anchor mechanism to an inner surface of the casing of a second standard diameter;

wherein the first standard diameter and the second standard diameter are at least two successive different standard diameters of wellbore casing being selected from a group comprising 5", 5½", 6", 6⅝" 7", 7⅝", 8⅝", 9⅝", 10¾", 11¾", 13⅜", 14", 16", 18⅝" and 20".

16. A method according to claim 15 wherein the first and second standard diameters are 9⅝" and 10¾".

17. An anchor mechanism for gripping wellbore casing, comprising:

a tool body being tubular with a central bore between an inlet and a first outlet, the inlet and first outlet being adapted for connection in a work string to be run into the casing;

a recess provided in and around an outer surface of the tool body;

a split cone arranged in the recess, the split cone having an outer surface including a first profile, the first profile having at least one ramp;

a plurality of selectively operable slips, each slip having an outer surface configured to grip an inner surface of the casing and an inner surface including a second profile, the second profiling mating with the first profile in a first configuration; and piston means operable to move the slips over the split cone between the first configuration wherein the slips are located within the recess, a second configuration wherein the outer surface of the slips contacts the inner surface of casing of a first standard diameter and a third configuration wherein the outer surface of the slip contacts the inner surface of casing of a second standard diameter:

wherein the first standard diameter and the second standard diameter are at least two successive different standard diameters of wellbore casing; and the tool body is rotatable relative to the slips via a bearing located between a base of the split cone and a side wall of the recess.

* * * * *